US007128606B2

(12) United States Patent
Sakamaki et al.

(10) Patent No.: US 7,128,606 B2
(45) Date of Patent: Oct. 31, 2006

(54) ELECTRICAL CONNECTOR

(75) Inventors: Kazushige Sakamaki, Tokyo (JP); Masato Minakata, Aichi (JP); Hiroshi Kobayashi, Aichi (JP); Atsushi Nishida, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 13 days.

(21) Appl. No.: 11/215,991

(22) Filed: Aug. 31, 2005

(65) Prior Publication Data

US 2006/0046553 A1 Mar. 2, 2006

(30) Foreign Application Priority Data

Aug. 31, 2004 (JP) ..... 2004-253160

(51) Int. Cl.
*H01R 13/40* (2006.01)
*H01R 13/514* (2006.01)

(52) U.S. Cl. ..... 439/595; 439/752.5

(58) Field of Classification Search ..... 439/752, 439/752.5, 595

See application file for complete search history.

(56) References Cited

U.S. PATENT DOCUMENTS 5,190,477 A * 3/1993 Akeda ..... 439/595
5,226,839 A 7/1993 Koumatsu et al.
5,378,170 A * 1/1995 Abe et al. ..... 439/595
5,626,499 A 5/1997 Yagi et al.
5,993,268 A * 11/1999 Yamaguchi ..... 439/752.5
6,068,524 A * 5/2000 Koumatsu ..... 439/752.5
6,375,501 B1 * 4/2002 Kojima ..... 439/595

FOREIGN PATENT DOCUMENTS

EP 0 977 318 A 2/2000
JP 10-144379 5/1998
JP 2004-103349 4/2004

OTHER PUBLICATIONS

European Patent Office, European Search Report, Application No. EP 05 10 7821, dated Nov. 28, 2005.

* cited by examiner

*Primary Examiner*—Tho D. Ta
(74) *Attorney, Agent, or Firm*—Barley Snyder LLC

(57) ABSTRACT

An electrical connector comprises a contact having a wire connection member and a mating contact receiving end. The mating contact receiving end includes an abutment edge and an inclined portion. A housing has a contact receiving opening with a contact receiving end. The housing has a projection extending into the contact receiving opening and a first bevelled surface opposing the projection. The first bevelled surface is arranged closer to the contact receiving end than the projection. The inclined portion engages the first bevelled surface to bias the abutment edge into the projection when the contact is incorrectly inserted into the contact receiving opening.

15 Claims, 13 Drawing Sheets

ELECTRICAL CONNECTOR

FIELD OF THE INVENTION

The invention relates to an electrical connector having a housing formed to prevent incorrect insertion of a contact therein.

BACKGROUND OF THE INVENTION

Traditionally, an electrical connector is assembled by inserting a contact into a contact receiving opening provided in a housing. When the contact is incorrectly or inversely inserted into the housing, particularly in the case of a substantially square contact, failure of engagement of the electrical connector with a mating connector is likely to occur. In order to prevent incorrect insertion, the contact and/or the housing have been formed with irregularities that only allow the contact to be inserted into the housing in the correct direction.

For example, Japanese Patent Publication No. 10-144379 teaches a housing having a step disposed on an inner wall of a contact receiving opening and a contact with a projection that abuts the step when it is inversely inserted into the housing. In addition, Japanese Patent Publication No. 2004-103349 teaches a connector having a housing with a projection provided in the contact receiving opening and a contact with a recess that avoids abutting the projection when correctly inserted in the contact receiving opening. The electrical connector also includes a stabilizer, which has been conventionally used to prevent incorrect insertion of the contact.

The recent trend toward smaller more high density electrical connectors requires that smaller contacts be developed having dimensions smaller than a diameter of a wire connected to the contact. The contact is configured to have a diameter as wide as the diameter of the wire at an end closest to a contact insertion end and a smaller diameter at an end opposite from the contact insertion end.

Because the contact insertion end must be large enough to accommodate the larger end of the contact, it is difficult to provide irregularities on the contact and the housing adjacent to the contact insertion end to prevent incorrect insertion of the contact. For example, since a gap will exist between the contact and the housing, a projection on the contact can easily advance into the housing without having to align with a recess in the housing, thus allowing incorrect insertion.

In order to solve this problem, it has been proposed that a front edge of the projection of the contact be engaged with a recess of the housing in order to further prevent incorrect insertion. However, the front edge of a small projection may easily scrape by an inner wall of the housing, allowing incorrect insertion. Further, even when the contact is inserted correctly, it is difficult to have the contact smoothly transition between the differently dimensioned areas within the housing. This is especially difficult when the electrical connector is connected to a wire having a cross section of about 0.22 to 0.5 mm.

SUMMARY OF THE INVENTION

It is therefore an object of the invention to provide an electrical connector that allows a contact to be smoothly inserted into the contact receiving opening when the contact receiving opening has varying dimensions and prevents incorrect insertion of the contact.

This and other objects are achieved by an electrical connector comprising a housing having a contact receiving opening with a contact receiving end. The contact receiving opening includes a first area and a second area. The first area is arranged at the contact receiving end and has a height larger than a height of the second area. The housing has a projection extending into the contact receiving opening and a first bevelled surface opposing the projection. The first bevelled surface is arranged closer to the contact receiving end than the projection.

This and other objects are further achieved by an electrical connector comprising a contact having a wire connection member and a mating contact receiving end. The mating contact receiving end includes an abutment edge and an inclined portion. A housing has a contact receiving opening with a contact receiving end. The housing has a projection extending into the contact receiving opening and a first bevelled surface opposing the projection. The first bevelled surface is arranged closer to the contact receiving end than the projection. The inclined portion engages the first bevelled surface to bias the abutment edge into the projection when the contact is incorrectly inserted into the contact receiving opening.

DETAILED DESCRIPTION OF THE INVENTION

Figure 1:
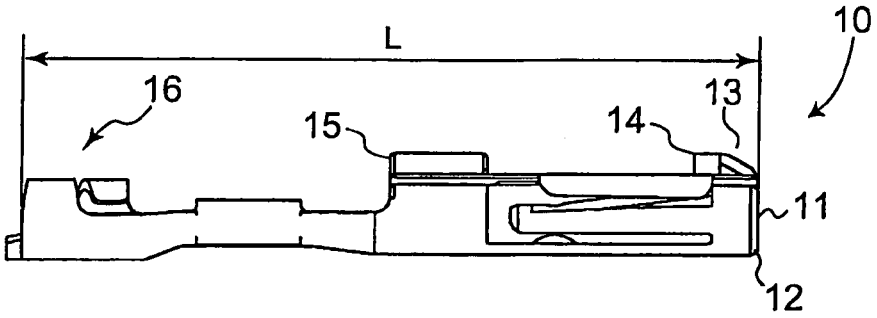
FIG. 1A is a side view of a contact.
FIG. 1B is a front view of the contact.
Figure 1:
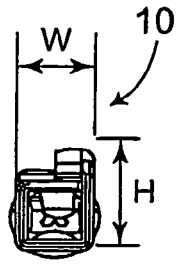

FIGS. 1A–1B show a contact 10. The contact 10 includes a mating contact receiving end 11. An abutment edge 12 is provided on a side of the mating contact receiving end 11. An inclined portion 13 is formed on a side opposing the abutment edge 12. A first engaging section 14 is formed adjacent to the inclined portion 13. A second engaging section 15 is formed substantially in a middle of the contact 10. A wire connection member 16 is formed at an end of the contact opposite from the mating contact receiving end 11. The contact 10 may have a height H of about 1.1 mm, a width W of about 1.0 mm, and a length L of about 7.8 mm.

Figure 2:
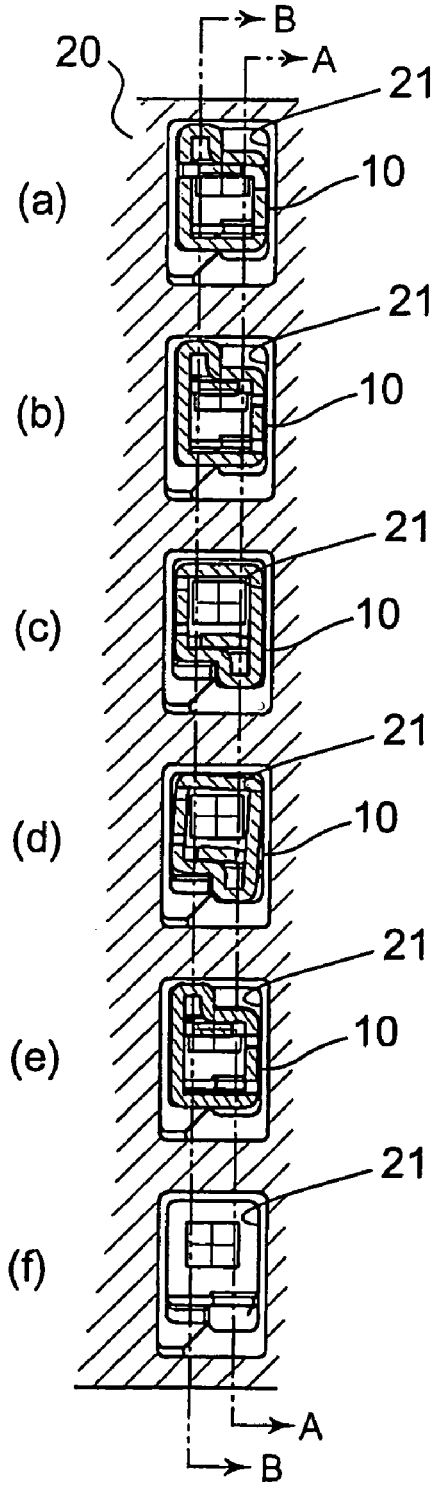
FIG. 2 is a sectional view taken along line C—C of FIG. 3 showing an electrical connector according to a first embodiment with the contact inserted therein.
Figure 3:
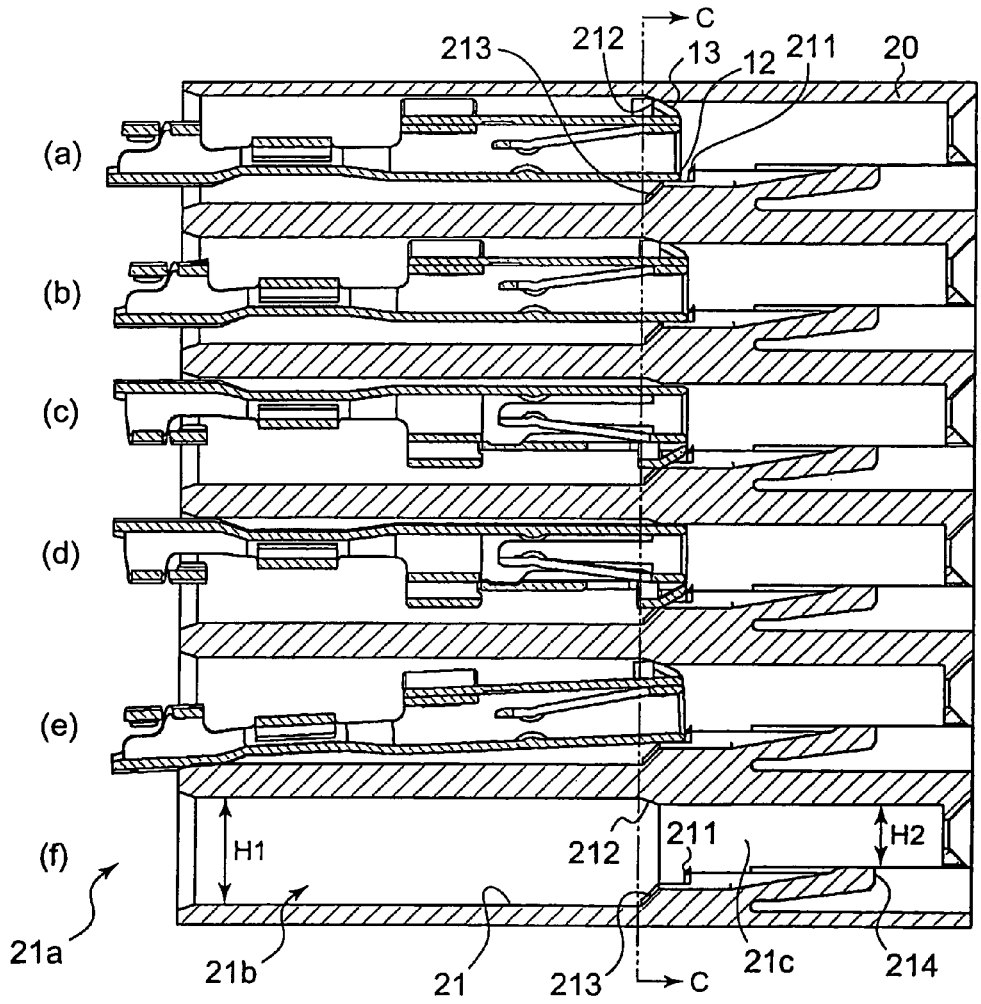
FIG. 3 is a sectional view taken along line A—A of FIG. 2.
Figure 4:
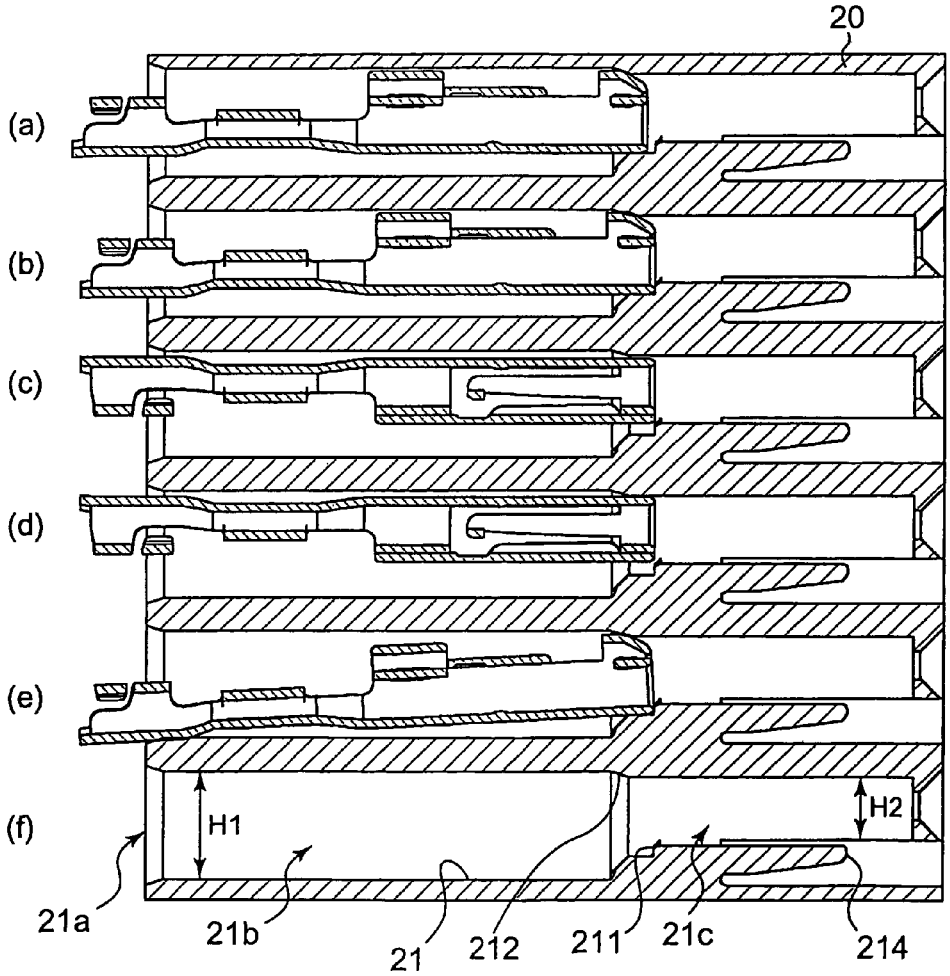
FIG. 4 is a sectional view taken along line B—B of FIG. 2.
Figure 5:
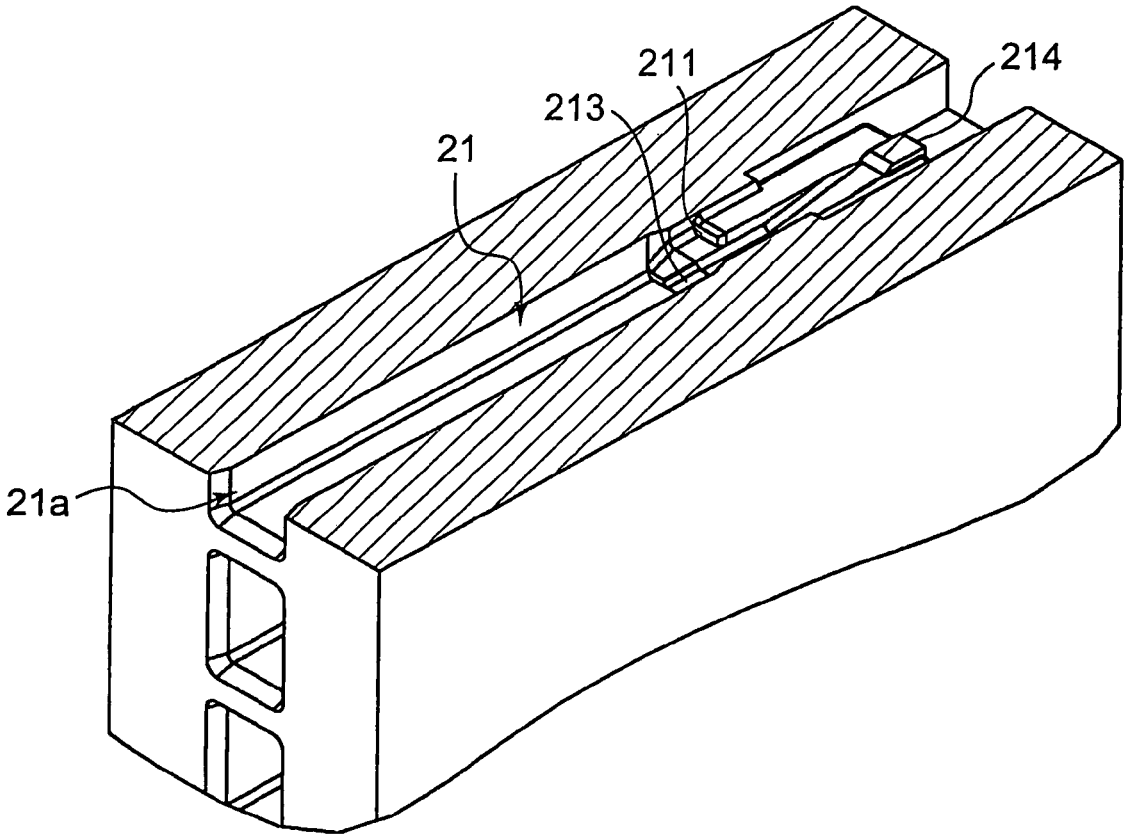
FIG. 5 is a partial sectional view of the electrical connector of FIG. 2.
Figure 6:
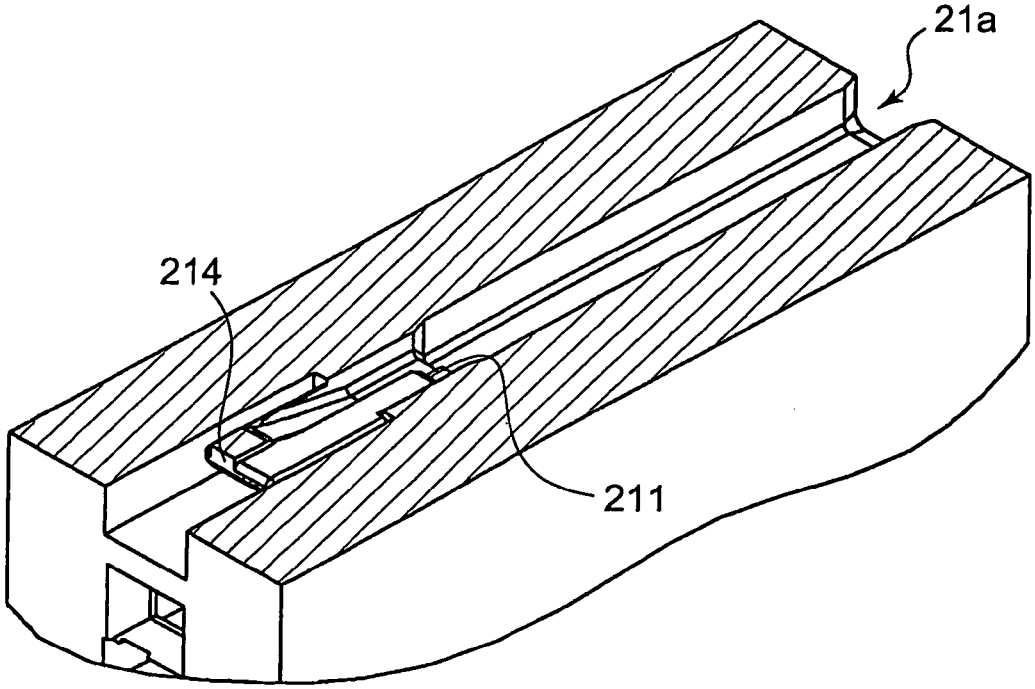
FIG. 6 is another partial sectional view of the electrical connector of FIG. 2.

FIGS. 2–7 show an electrical connector according to a first embodiment of the invention. As shown in FIG. 2, the electrical connector includes a housing 20 having contact receiving openings 21. Although the contact receiving openings 21 are illustrated as being arranged in a single column, it will be appreciated by those skilled in the art that the contact receiving openings 21 may also be arranged in a matrix. As shown in FIGS. 3–4, each of the contact receiving openings 21 has a contact insertion end 21*a*. The contact receiving openings 21 comprise a first area 21*b* and a second area 21*c*. The first area 21*b* is beside the contact insertion end 21*a* and has a height H1. The first area accommodates a wire (not shown) connected to the contact 10. The second area 21*c* has a height H2 that is smaller than the height H1 and accommodates the contact 10.

Figure 7:
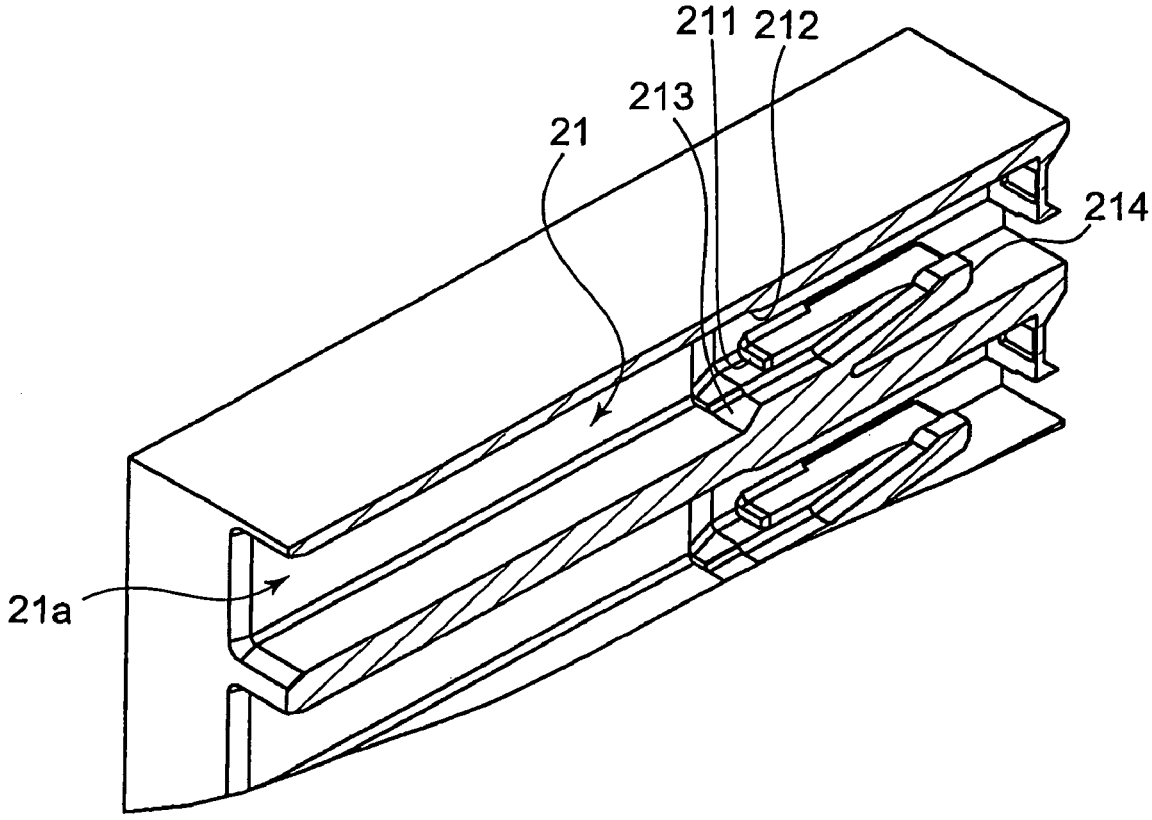
FIG. 7 is another partial sectional view of the electrical connector of FIG. 2.

As shown in FIGS. 3 and 7, the contact receiving opening 21 is provided with a projection 211, a first bevelled surface 212, a second bevelled surface 213, and an engagement member 214. The projection 211 extends upward from the housing 20 into the contact receiving opening 21 and acts as a stopper to prevent inverse insertion of the contact 10 into the contact receiving opening 21. The first bevelled surface 212 opposes the projection 211 and is positioned closer to the contact insertion end 21*a* than the projection 211. The second bevelled surface 213 opposes the first bevelled surface 212 and corresponds thereto. The second bevelled surface 213 is arranged beside the projection 211 and is positioned closer to the contact insertion end 21*a* than the projection 211. The engagement member 214 is provided in the second area 21*c*.

The method of inserting the contact 10 into the electrical connector according to the first embodiment will now be explained with reference to FIGS. 2–4. Rows (a)–(f) shown in FIG. 2 correspond to rows (a)–(f) shown in FIGS. 3–4. Row (f) shows the contact receiving opening 21 without the contact 10 inserted therein.

Row (a) shows the contact 10 inversely inserted halfway into the contact receiving opening 21 of the housing 20. In this position, the inclined portion 13 of the contact 10 interferes with the first bevelled surface 212 of the contact receiving opening 21. The contact 10 is therefore subjected to a force perpendicular to a direction of insertion. As shown in row (b), when the contact 10 is inserted further, the abutment edge 12 abuts the projection 211 so that the contact 10 can not be inserted further into the contact receiving opening 21. Incorrect insertion of the contact 10 into the contact receiving opening 21 is therefore prevented.

Row (e) shows the contact 10 inversely inserted halfway into the contact receiving opening 21 of the housing 20 at a slight inclination with the mating contact receiving end 11 tilted upward. The inclined portion 13 of the contact 10 interferes with the first bevelled surface 212 of the contact receiving opening 21. The contact 10 is therefore subjected to a force perpendicular to a direction of insertion. When the contact 10 is inserted further, the abutment edge 12 abuts the projection 211 so that the contact 10 can not be inserted further into the contact receiving opening 21. Thus, even if the contact 10 is inserted at an inclination, the abutment edge 12 of the contact 10 still abuts the projection 211 to prevent incorrect insertion of the contact 10.

Row (c) shows the contact 10 correctly inserted halfway into the contact receiving opening 21 of the housing 20. The inclined portion 13 of the contact 10 interferes with the second bevelled surface 213 provided in the contact receiving opening 21, so that the contact 10 is lifted in a direction opposite from the projection 211. The contact 10 is therefore lifted over and by the projection 211 even though there is a difference in the height H1 of the first area 21*b* and the height H2 of the second area 21*c*. The contact 10 can therefore be fully inserted into the housing 20.

Row (d) shows the contact 10 correctly inserted halfway into the contact receiving opening 21 of the housing 20 at a slight inclination. As best shown in FIG. 2, the contact 10 can still advance over the projection 211 even though it is inserted at a slight inclination.

When the contact 10 is completely inserted into a final position in the contact receiving opening 21 of the housing 20, the engagement member 214 engages behind the first engaging section 14 of the contact 10 to prevent the contact 10 from being removed from the contact receiving opening 21.

Figure 8:
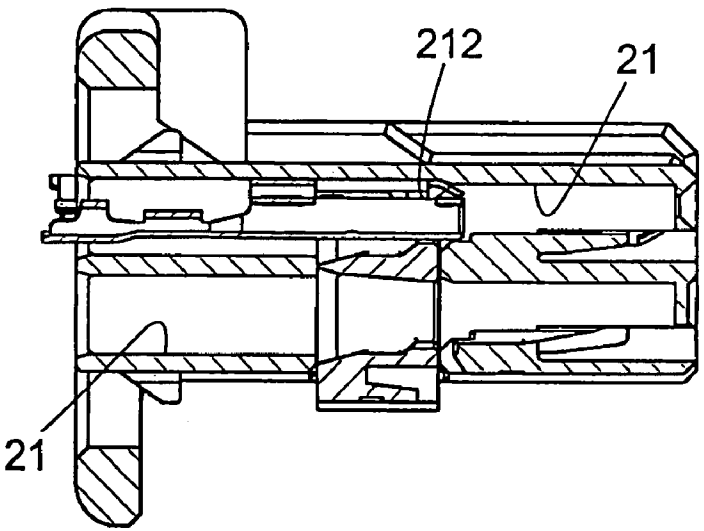
FIG. 8A is a sectional view of the electrical connector according to a second embodiment of the invention showing the contact inversely inserted halfway therein.
FIG. 8B is another sectional view of the electrical connector of FIG. 8A showing the contact inversely inserted halfway therein.
Figure 8:
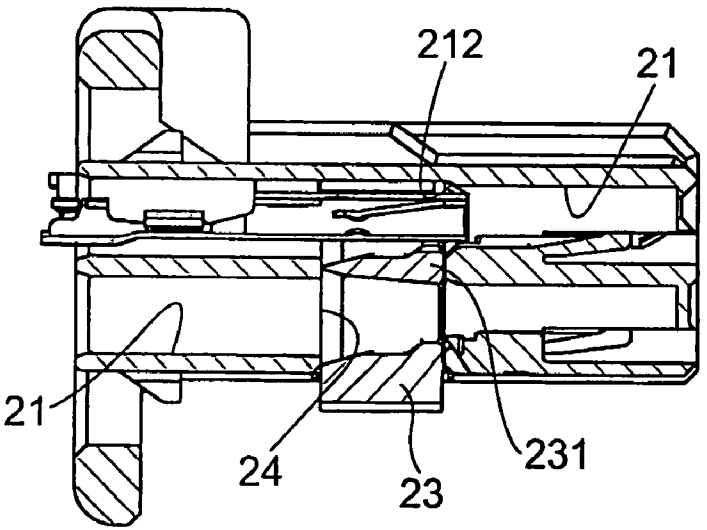
Figure 9:
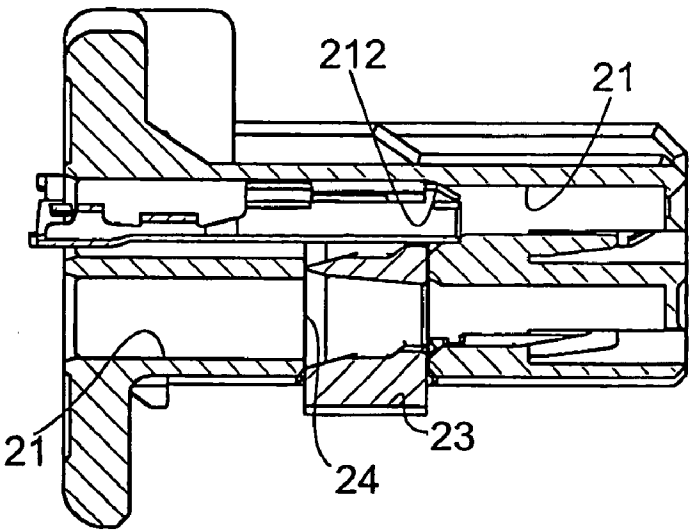
FIG. 9A is a sectional view of the electrical connector of FIG. 8A showing the contact inversely inserted therein.
FIG. 9B is another sectional view of the electrical connector of FIG. 8A showing the contact inversely inserted therein.
Figure 9:
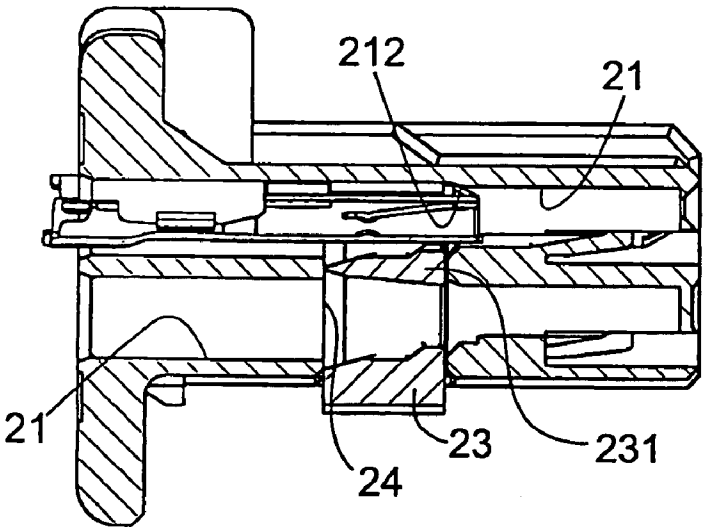
Figure 10:
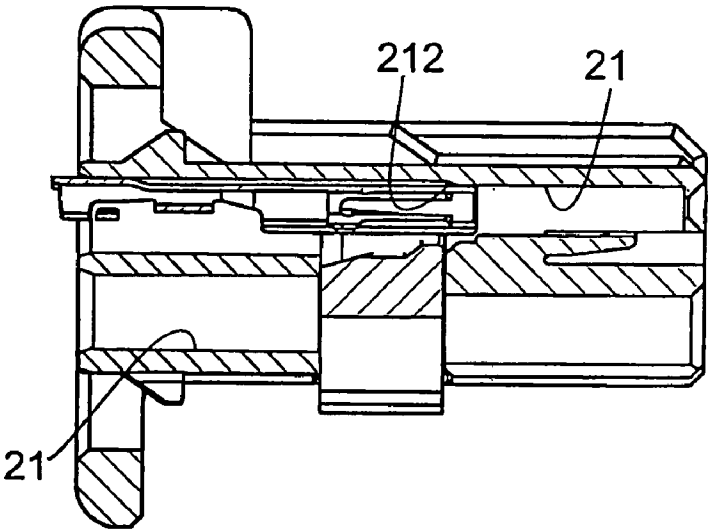
FIG. 10A is a sectional view of the electrical connector of FIG. 8A showing the contact inserted therein.
FIG. 10B is another sectional view of the electrical connector of FIG. 8A showing the contact inserted therein.
Figure 10:
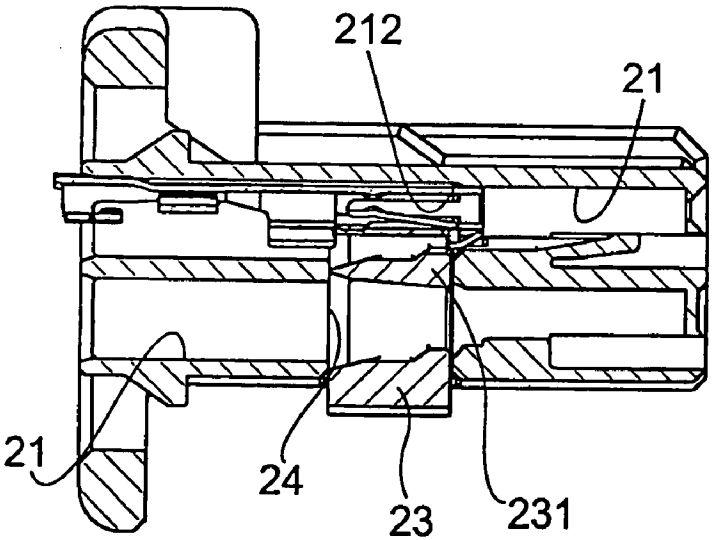
Figure 11:
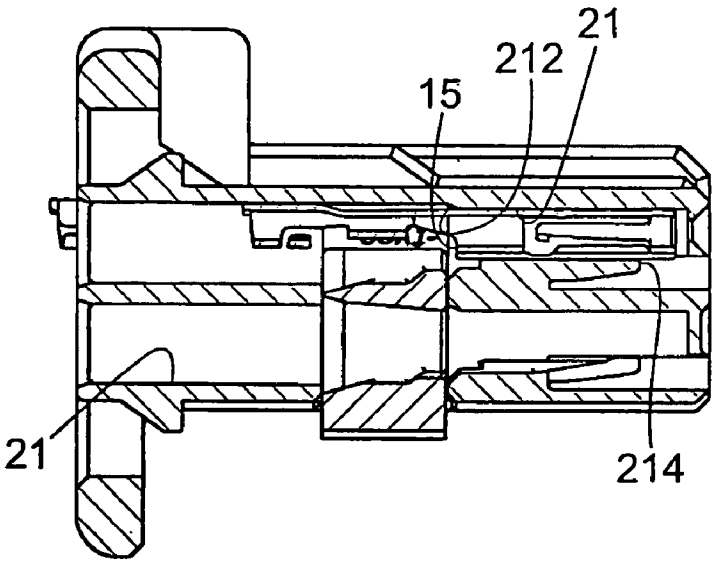
FIG. 11A is a sectional view of the electrical connector of FIG. 8A showing the contact fully inserted therein.
FIG. 11B is another sectional view of the electrical connector of FIG. 8A showing the contact fully inserted therein.
Figure 11:
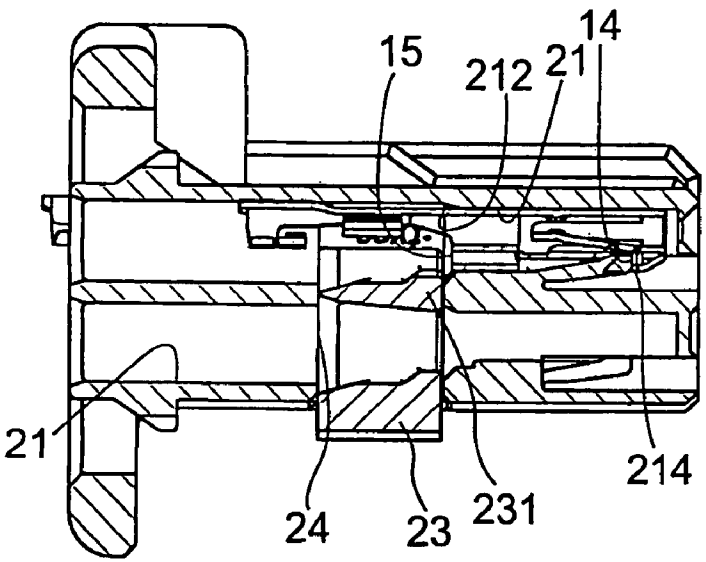

FIGS. 8A–11B show an electrical connector according to a second embodiment of the invention. Elements of the second embodiment which are identical to elements of the first embodiment will be explained using the same reference numerals and further description thereof will be omitted. Unlike the electrical connector of the first embodiment, the electrical connector of the second embodiment has a second engagement member 23 that is received in an engagement member receiving opening 24, as shown in FIG. 8A. The second engagement member 23 has an engaging section 231. FIGS. 8A–11B show a temporary engagement state before the second engagement member 23 is received in the engagement member receiving opening 24.

The method of inserting the contact 10 into the electrical connector according to the second embodiment will now be explained with reference to FIGS. 8A–11B.

FIGS. 8A–8B show the contact 10 inversely inserted halfway into the contact receiving opening 21 of the housing 20. In this position, the inclined portion 13 of the contact 10 interferes with the first bevelled surface 212 of the contact receiving opening 21. The contact 10 is therefore subjected to a force perpendicular to a direction of insertion. As shown in FIGS. 9A–9B, when the contact 10 is inserted further, the abutment edge 12 abuts the projection 211 so that the contact 10 can not be inserted further into the contact receiving opening 21. Incorrect insertion of the contact 10 into the contact receiving opening 21 is therefore prevented.

FIGS. 10A–10B show the contact 10 correctly inserted halfway into the contact receiving opening 21 of the housing 20. The inclined portion 13 of the contact 10 interferes with the second bevelled surface 213 provided in the contact receiving opening 21, so that the contact 10 is lifted in a direction opposite from the projection 211. The contact 10 is therefore lifted over and by the projection 211 even though there is a difference in the height H1 of the first area 21*b* and the height H2 of the second area 21*c*. The contact 10 can therefore be fully inserted into the housing 20 into the final position, as shown in FIGS. 11A–11B.

When the contact 10 is completely inserted into the final position, the engagement member 214 of the housing 20 engages behind the first engaging section 14 of the contact 10 to prevent the contact 10 from being removed from the contact receiving opening 21. The second engagement member 23 is received in the engagement member receiving opening 24 from the state shown in FIGS. 11A–11B. The engaging section 231 of the second engagement member 23 engages behind the second engaging section 15 of the contact 10 and is permanently engaged therewith to further prevent the contact 10 from being removed from the housing 20.

Figure 12:
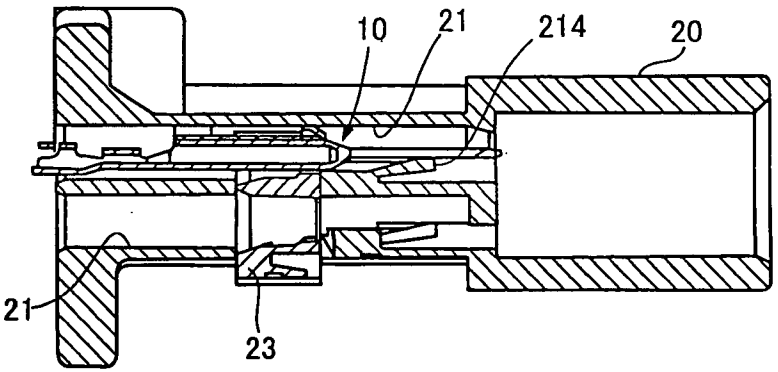
FIG. 12A is a sectional view of the electrical connector according to a third embodiment of the invention showing the contact inversely inserted halfway therein.
FIG. 12B is another sectional view of the electrical connector of FIG. 12A showing the contact inversely inserted halfway therein.
Figure 12:
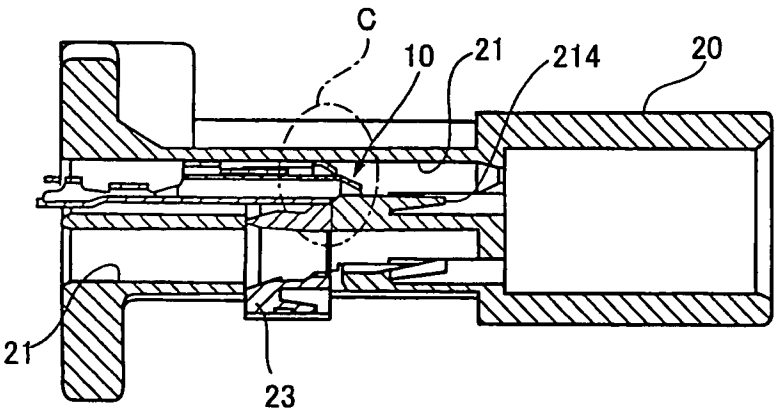
Figure 13:
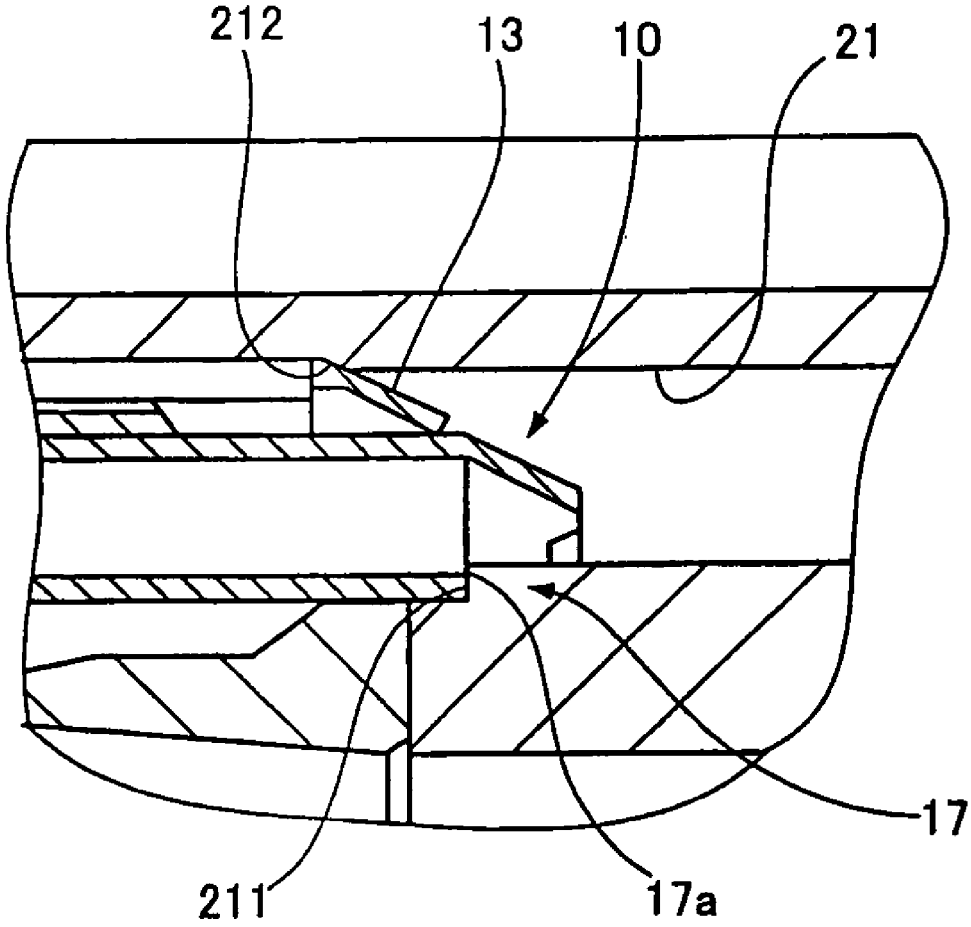
FIG. 13 is an enlarged sectional view of section C shown in FIG. 12A.

FIGS. 12A–13 show an electrical connector according to a third embodiment of the invention. Elements of the third embodiment which are similar to elements of the first and second embodiments will be explained using the same reference numerals irrespective of some differences in form and further description thereof will be omitted. Unlike the contact 10 in the first and second embodiments, which is a female contact, the contact 10 of the third embodiment is a male contact. As shown in FIG. 13, the contact 10 has a substantially cylindrical mating contact receiving end 11. A notch 17 and an abutment edge 17*a* that corresponds to the abutment edge 12 of the female contact in the first and the second embodiments is provided proximate the mating contact receiving end 11.

FIGS. 12A–13 show the contact 10 inversely inserted halfway into the contact receiving opening 21 of the housing 20. In this position, the inclined portion 13 of the contact 10 interferes with the first bevelled surface 212 of the contact receiving opening 21. The contact 10 is therefore subjected to a force perpendicular to a direction of insertion. When the contact 10 is inserted further, the abutment edge 17*a* of the notch 17 abuts the projection 211 so that the contact 10 can not be inserted further into the contact receiving opening 21. Incorrect insertion of the contact 10 into the contact receiving opening 21 is therefore prevented.

When the contact 10 is correctly inserted into the contact receiving opening 21 of the housing 20, the abutment edge 17*a* of the notch 17 and the inclined portion 13 function in the same manner as the abutment edge 12 and the inclined portion 13 described in the first and the second embodiments. Further description thereof will therefore be omitted.

In the electrical connector according to the embodiments described herein, the projection 211 and the first bevelled surface 212 provided on the contact receiving opening 21 and the inclined portion 13 and the abutment edge 12 provided on the contact 10. Thus, when the contact 10 is inversely inserted, the first bevelled surface 212 of the housing 20 interferes with the inclined portion 13 of the contact 10, so that a linear or planer abutment edge 12 of the mating contact receiving end 11 of the contact 10 abuts the projection 211 to prevent wrongful insertion of the contact 10. In addition, when the contact 10 is correctly inserted, the abutment edge 12 of the contact 10 is guided by the first bevelled surface 212 of the housing 20, so that the inclined portion 13 of the contact 10 can avoid abutting the projection 211 of the housing 20 and can be guided by the projection 211. Thus, the contact 10 is smoothly inserted into the final position in the housing 20.

Additionally, the second bevelled surface 213 interferes with the inclined portion 13 to bias the contact 10 away from the projection 211. Thus, the contact 10 can be smoothly inserted into the housing 20 even when the contact receiving opening 21 has a larger dimension near the contact insertion end 21*a*.

The foregoing illustrates some of the possibilities for practicing the invention. Many other embodiments are possible within the scope and spirit of the invention. For example, although the inclined portion 13 and the first and second bevelled surfaces 212, 213 are illustrated as being inclined or tapered, it will be appreciated by those skilled in the art that these elements may be of any configuration, such as, a circular arc, a combination of a taper and a circular arc, etc. It is, therefore, intended that the foregoing description be regarded as illustrative rather than limiting, and that the scope of the invention is given by the appended claims together with their full range of equivalents.

We claim:

1. An electrical connector, comprising;

a housing having a contact receiving opening with a contact insertion end, the contact receiving opening including a first area and a second area, the first area being arranged at the contact insertion end and having a height larger than a height of the second area;

the housing having a projection extending into the contact receiving opening for preventing inverse insertion of a contact into the contact receiving opening and a first bevelled surface opposing the projection, the first bevelled surface being arranged closer to the contact insertion end than the projection: and the housing includes a second beveled surface arranged opposite the first beveled surface and beside the projection, the second bevelled surface being arranged closer to the contact insertion end than the projection.

2. The electrical connector of claim 1, wherein the first bevelled surface and the projection are arranged between the contact insertion end and the second area.

3. The electrical connector of claim 1, wherein the second bevelled surface and the projection are arranged on the same wall of the housing.

4. The electrical connector of claim 1, further comprising an engagement member extending from the housing and arranged in the second area.

5. The electrical connector of claim 4, further comprising a second engagement member extending from the housing and arranged in the first area.

6. The electrical connector of claim 1, further comprising a contact having a wire connection member and a mating contact receiving end, the mating contact receiving end having a dimension corresponding to the second area.

7. The electrical connector of claim 6, wherein the mating contact receiving end includes an abutment edge and an inclined portion, the inclined portion engaging the first bevelled surface to bias the abutment edge into the projection when the contact is incorrectly inserted into the contact receiving opening.

8. An electrical connector, comprising;

a contact having a wire connection member and a mating contact receiving end, the mating contact receiving end including an abutment edge and an inclined portion;

a housing having a contact receiving opening with a contact insertion end, the housing having a projection extending into the contact receiving opening for preventing inverse insertion of the contact into the contact receiving opening and a first bevelled surface opposing the projection, the first bevelled surface being arranged closer to the contact receiving end than the projection; and the inclined portion engaging the first bevelled surface to bias the abutment edge into the projection when the contact is incorrectly inserted into the contact receiving opening.

9. The electrical connector of claim 8, wherein the housing includes a second bevelled surface arranged opposite the first bevelled surface and beside the projection, the second bevelled surface being arranged closer to the contact insertion end than the projection, the inclined portion engaging the second bevelled surface to raise the contact over the projection when the contact is correctly inserted into the contact receiving opening.

10. The electrical connector of claim 8, wherein the contact is a male contact and includes a notch formed adjacent to the abutment edge.

11. The electrical connector of claim 8, wherein the contact receiving opening includes a first area and a second area, the first area being arranged at the contact receiving end and having a height larger than a height of the second area.

12. The electrical connector of claim 11, wherein the mating contact receiving end has a dimension corresponding to the second area.

13. The electrical connector of claim 11, wherein the first bevelled surface and the projection are arranged between the contact insertion end and the second area.

14. The electrical connector of claim 8, wherein the contact includes a first engaging section and the housing includes an engagement member extending from the housing that engages the first engaging section.

15. The electrical connector of claim 14, wherein the contact includes a second engaging section and the housing includes a second engagement member extending from the housing that engages the second engaging section.

* * * * *